United States Patent [19]

Josemans

[11] 4,341,935

[45] Jul. 27, 1982

[54] SLIDE SWITCH

[75] Inventor: Leo J. M. Josemans, Farmville, Va.

[73] Assignee: Stackpole Components Company, Raleigh, N.C.

[21] Appl. No.: 169,665

[22] Filed: Jul. 17, 1980

[51] Int. Cl.[3] ..... H01H 15/04

[52] U.S. Cl. ..... 200/252; 200/16 C

[58] Field of Search ..... 200/252, 16 R, 16 A, 200/16 C, 257, 303, 260

[56] References Cited

U.S. PATENT DOCUMENTS

| | | | |
|---|---|---|---|
| 3,793,491 | 2/1974 | Cryer | 200/16 R |
| 3,996,431 | 12/1976 | Brown | 200/16 C |
| 4,072,834 | 2/1978 | Godfrey | 200/16 C |

FOREIGN PATENT DOCUMENTS

| | | | |
|---|---|---|---|
| 2900726 | 7/1979 | Fed. Rep. of Germany | 200/16 C |

*Primary Examiner*—Willis Little

*Attorney, Agent, or Firm*—Brown, Flick & Peckham

[57] ABSTRACT

A slide is movable by an actuating knob back and forth in a rectangular housing and is attached to a movable metal contact below it by elements integral with the slide. The contact is pressed downwardly by a spring mounted in a bore in the slide. The housing, slide and knob are molded from insulating material. A pair of stationary electric contacts are mounted in the bottom of the housing in positions to be bridged by the movable contact when the slide is in a predetermined position in the housing. The slide may be provided inside the housing with a pair of integral resilient indexing prongs extending laterally into notches in the side walls of the housing.

2 Claims, 4 Drawing Figures

SLIDE SWITCH

Slide switches are well known, in which a slide is movable back and forth in a housing to move a movable contact into bridging engagement with a pair of fixed contacts, against which the bridging contact is pressed by a spring carried by a slide.

It is among the objects of this invention to provide an inexpensive slide switch, in which the only exposed metal parts are the terminals, in which the slide and actuating knob and spring and movable contact are joined together to form a unitary sub-assembly, and in which resilient indexing prongs integral with the slide project from its opposite sides into indexing notches in the side walls of the housing.

The preferred embodiment of the invention is illustrated in the accompanying drawings, in which FIG. 1 is a plan view, partly broken away;

Figure 4:
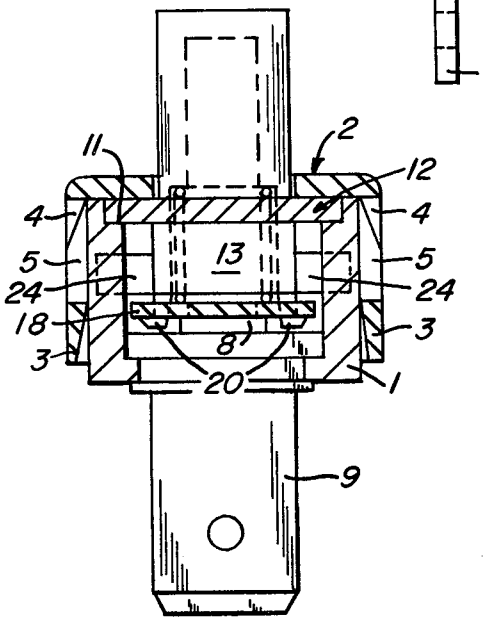
FIG. 4 is a vertical section taken on the line IV—IV of FIG. 3.
Figure 1:
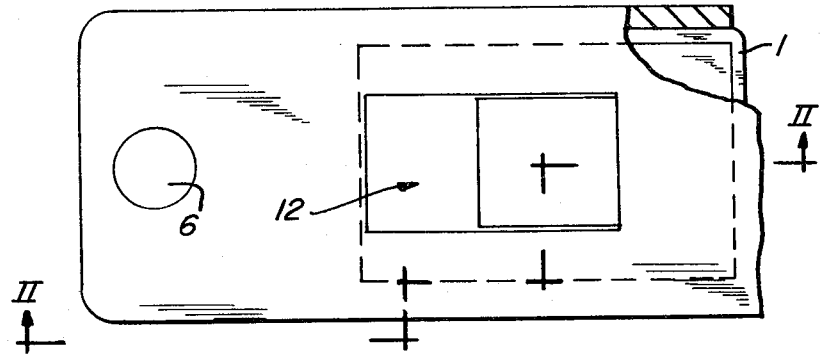

Referring to the drawings, the switch housing is formed from a rectangular case 1 that has an open top and a cover 2 for the top of the case. These two members are made of insulating material, such as a plastic. The cover is a snap-on cover that has a flat top and downwardly extending side flanges 3. Each side flange is provided with a rectangular opening 4, into which a retaining boss 5 molded on the adjoining side of the case projects. The bosses are inclined downwardly and outwardly as shown in FIG. 4 so that in applying the cover to the case the lower edges of the side flanges sliding down the bosses spring the flanges farther apart until the lower walls of openings 4 reach the bottom of the bosses, whereupon the flanges snap in against the sides of the case. The flat top of the cover extends beyond the ends of the case and is provided near its opposite ends with openings 6 for suitable fasteners to secure the switch in place.

Figure 2:
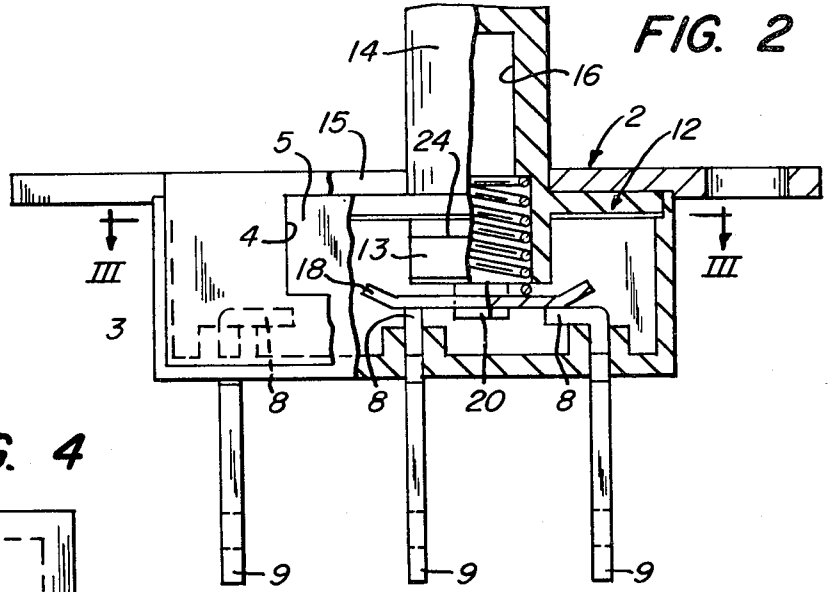
FIG. 2 is a side view and cross section taken on the line II—II of FIG. 1.

Inside the switch housing, as shown in FIG. 2, there are at least two stationary electric contacts 8 spaced lengthwise of the housing near its bottom. These contacts are the upper ends of electric terminals 9 that extend down through the bottom of the case. Preferably, one of the contacts is located midway between the ends of the case.

Figure 3:
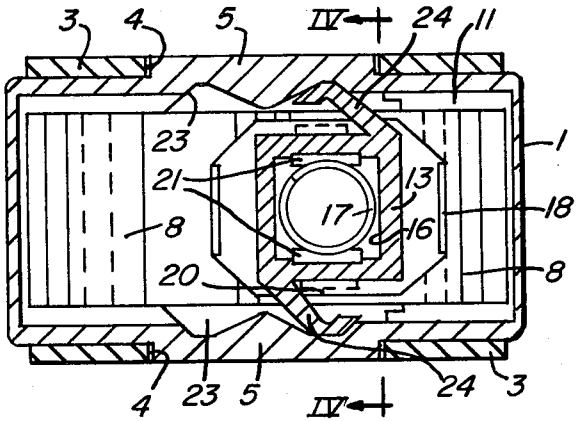
FIG. 3 is a horizontal section taken on the line III—III of FIG. 2.

Slidably mounted inside the switch housing on ledges 11 formed near the top of the case is a slide 12 that engages the lower surface of the cover. As shown in FIGS. 3 and 4, this slide, which is made of an insulating material, such as a plastic, has a downwardly extending central portion 13 directly below an actuating knob 14 that extends up through a longitudinal slot 15 in the cover. The downwardly extending central portion 13 and the knob are provided with a downwardly opening bore 16, in which there is a coil spring 17 that presses a movable electric contact 18 down against two underlying stationary contacts 8 when the slide is at one end of the housing, whereby to bridge the two fixed contacts.

The movable or bridging contact has a flat body and upwardly inclined ends. It is secured to the slide by a pair of hooks 20 extending downwardly from the bottom of the slide and through slots 21 in the contact near its opposite sides. The lower ends of the hooks extend outwardly beneath the contact. The coil spring presses the contact down against the lower ends of the hooks before the slide is placed in the housing, and the contact holds the coil spring in place. Consequently, the slide, knob, spring and movable contact form a sub-assembly that can be handled as a unit. Preferably, the upper surfaces of the laterally projecting lower ends of the hooks are convex so that the movable contact can rock on the hooks, if necessary, to provide equal contact pressure. As shown in FIG. 4, the center stationary contact is narrow enough for the hooks to pass by it when the slide is moved from one end of the housing to the other end.

To hold the slide at at least one end of the housing, the opposite sides of the case are provided with indexing notches 23 that receive the outer ends of a pair of indexing prongs 24 integral with the adjacent sides of the central portion 13 of the slide, as shown in FIG. 3. These prongs are inclined lengthwise of the case so that their outer ends can be flexed toward each other when sufficient pressure is applied to the knob to move the prongs out of the notches that have slanting sides. Preferably, there are two indexing notches in each side of the case for a two-position switch so that the slide will be held by the indexing prongs when at either end of the housing. For a three-position switch, there would be three notches in each side of the case. Although both indexing prongs may extend toward the same end of the case, it is preferred that they extend in opposite directions as shown to provide equalization of the operating force required for either direction of travel of the slide.

It will be observed that except for the projecting terminals, all exposed parts of this switch are molded from insulating material, thereby protecting the user against electrical shock. The spring and the contacts are concealed inside the housing. This switch is well adapted to automated assembly.

According to the provisions of the patent statutes, I have explained the principle of my invention and have illustrated and described what I now consider to represent its best embodiment. However, I desire to have it understood that, within the scope of the appended claims, the invention may be practiced otherwise than as specifically illustrated and described.

I claim:

1. A slide switch comprising a rectangular housing having a top provided with a longitudinal slot, a slide inside the housing movable lengthwise thereof and formed of insulating material, an actuating knob integral with the slide extending out through said slot, a movable metal contact below the slide, a pair of hooks extending downwardly from the slide at opposite sides of said housing, said movable contact being provided with a pair of openings through which said hooks extend with the lower ends of the hooks extending laterally beneath the contact for locking it to the slide, the slide above the contact being provided with a downwardly opening bore, a spring in said bore pressing said contact downwardly, the slide and knob and spring and movable contact forming a unitary subassembly, a pair of stationary electric contacts mounted in the bottom of said housing in positions to be bridged by said movable contact when the slide is in a predetermined position in the housing, said lower ends of the hooks being spaced apart laterally of the lengthwise path of movement of said slide and far enough to freely pass one of said stationary contacts when the slide moves said movable contact away from the adjacent stationary contact, and electric terminals joined to said stationary contacts and extending out of the housing.

2. A slide switch according to claim 1, in which the upper surfaces of said laterally extending lower ends of the hooks are convex to permit the movable contact to rock thereon.

* * * * *